US009812102B2

(12) United States Patent
de Chadenedes et al.

(10) Patent No.: US 9,812,102 B2
(45) Date of Patent: Nov. 7, 2017

(54) ERGONOMIC SUPPORT APPARATUS

(71) Applicants: John de Chadenedes, Bainbridge Island, WA (US); Roger Ferguson, Poulsbo, WA (US)

(72) Inventors: John de Chadenedes, Bainbridge Island, WA (US); Roger Ferguson, Poulsbo, WA (US)

( * ) Notice: Subject to any disclaimer, the term of this patent is extended or adjusted under 35 U.S.C. 154(b) by 0 days.

(21) Appl. No.: 15/094,915

(22) Filed: Apr. 8, 2016

(65) Prior Publication Data

US 2016/0300553 A1 Oct. 13, 2016

Related U.S. Application Data

(60) Provisional application No. 62/146,076, filed on Apr. 10, 2015, provisional application No. 62/166,592, filed on May 26, 2015.

(51) Int. Cl.
*G10G 5/00* (2006.01)

(52) U.S. Cl.
CPC ..... *G10G 5/005* (2013.01)

(58) Field of Classification Search
CPC ..... G10G 5/005
See application file for complete search history.

(56) References Cited

U.S. PATENT DOCUMENTS 413,807 A * 10/1889 Loeser et al. ..... G10D 3/18 224/910
491,372 A * 2/1893 Narberti ..... G10D 3/18 84/280
925,481 A * 6/1909 Johns ..... G10D 3/18 84/280
950,873 A * 3/1910 Smith ..... G10D 3/18 84/280
1,199,685 A * 9/1916 Gaylord ..... G10D 3/18 84/280
1,275,291 A * 8/1918 Nelson ..... G10D 3/18 84/280
1,315,015 A * 9/1919 Doyle ..... G10D 3/18 84/278
1,337,459 A * 4/1920 Lappalainen ..... G10D 3/18 84/280
1,431,007 A * 10/1922 Kenne ..... G10D 3/18 84/278
1,879,480 A * 9/1932 Pures ..... A45F 3/14 224/260
1,895,749 A * 1/1933 Bishop ..... G10D 3/18 84/279

(Continued)

*Primary Examiner* — Robert W Horn

(74) *Attorney, Agent, or Firm* — Seed IP Law Group LLP

(57) ABSTRACT

A specialized harness supports the weight of a violin or a viola, eliminating the need for the player to engage the neck or chin to support the instrument while playing. The harness transfers the weight of the instrument to larger muscles in the player's back or shoulder, thus providing ergonomic assistance to the player, and encouraging beneficial posture while playing. Such an ergonomic apparatus may be further equipped with a counterweight. Use of the violin harness permits playing freely, without a need for customary accessories. The violin harness may allow those with upper torso or neck injuries, who might otherwise be prevented from playing the violin, to do so comfortably and painlessly.

17 Claims, 18 Drawing Sheets

(56) References Cited

U.S. PATENT DOCUMENTS 1,924,640 A * 8/1933 Draves ..... A61F 5/028 128/95.1
2,061,464 A * 11/1936 Heimers ..... G10D 3/18 84/280
2,113,534 A * 4/1938 Brown ..... A61B 17/1327 606/203
2,282,635 A * 5/1942 Amendola ..... A61F 5/24 24/188
2,449,641 A * 9/1948 Cidissen ..... A61F 5/03 128/96.1
2,576,018 A * 11/1951 Johnson ..... G10D 3/18 224/201
2,756,753 A * 7/1956 Means ..... A61B 17/1327 128/885
2,902,895 A * 9/1959 Sokolik ..... G10D 3/18 84/280
3,136,197 A * 6/1964 Bried ..... G10D 3/18 84/280
3,192,817 A * 7/1965 Schmidt ..... G10G 5/00 84/327
3,481,517 A * 12/1969 Aukerman ..... A47D 13/025 224/160
3,564,590 A * 2/1971 Hebel ..... A45C 13/38 206/287
3,822,628 A * 7/1974 Quemore, Sr. ..... G10D 3/18 84/275
3,833,751 A * 9/1974 Chapman ..... G10H 3/18 84/327
3,910,577 A * 10/1975 Boyle ..... A63B 21/065 482/105
D244,628 S * 6/1977 Wright ..... D21/682
4,254,901 A * 3/1981 McIntosh ..... A45F 5/00 224/258
4,355,801 A * 10/1982 Thomsen ..... A63B 21/065 482/105
4,389,916 A * 6/1983 Ruthstrom ..... G10D 3/18 84/278
D275,302 S * 8/1984 Rotella ..... D21/684
4,528,700 A * 7/1985 Johnston ..... A41F 9/002 2/338
4,765,219 A * 8/1988 Alm ..... G10D 1/02 224/910
D299,373 S * 1/1989 Parker ..... D21/682
4,798,497 A * 1/1989 Bloos ..... B63C 11/30 405/185
4,802,613 A * 2/1989 Tierney ..... A45F 5/00 224/606
D306,332 S * 2/1990 Mayfield ..... D21/681
4,913,027 A * 4/1990 Twohy ..... G10D 3/18 84/280
4,979,760 A * 12/1990 Derrah ..... A63C 10/24 280/11.36
4,991,758 A * 2/1991 Eaneff ..... F16M 13/04 224/200
4,995,604 A * 2/1991 Lynch ..... A63B 21/0606 434/254
5,105,806 A * 4/1992 Woodhouse ..... A61F 5/028 128/112.1
5,137,502 A * 8/1992 Anastasi ..... A63B 21/072 482/105
5,400,683 A * 3/1995 LaFlame ..... G10G 5/005 224/265
5,472,000 A * 12/1995 Olsen ..... A61F 5/3769 128/878
5,483,860 A * 1/1996 Adams ..... G10G 5/005 224/257
5,528,971 A * 6/1996 Wood ..... G10D 3/18 84/275
5,692,996 A * 12/1997 Widerman ..... A63B 21/072 482/106
5,741,206 A * 4/1998 Anastasi ..... A63B 21/065 482/105
5,780,756 A * 7/1998 Babb ..... G10D 3/18 84/280
D409,695 S * 5/1999 Rojas ..... D21/680
5,913,464 A * 6/1999 Haberlein ..... A45F 3/14 224/259
5,918,785 A * 7/1999 Irose ..... A45F 3/14 224/250
5,937,491 A * 8/1999 Chih ..... A45C 13/00 24/265 H
5,938,572 A * 8/1999 Spano ..... A63B 21/0603 482/105
5,941,436 A * 8/1999 Washington ..... A45C 15/00 224/259
D421,076 S * 2/2000 Lincir ..... D21/681
6,040,509 A * 3/2000 Fanella ..... G10G 5/005 84/280
6,199,731 B1 * 3/2001 Lehoux ..... A45F 3/14 224/259
6,250,525 B1 * 6/2001 Lehoux ..... G10G 5/005 224/257
D450,361 S * 11/2001 Harms ..... D21/680
6,312,364 B1 * 11/2001 Selsam ..... A63B 21/06 206/501
D454,167 S * 3/2002 Lincir ..... D21/680
6,364,186 B1 * 4/2002 Gilmour ..... A45F 3/02 224/625
D469,484 S * 1/2003 Dawson ..... D21/662
D474,517 S * 5/2003 Harms ..... D21/680
6,736,765 B2 * 5/2004 Wallace ..... A63B 21/072 482/106
6,789,671 B2 * 9/2004 Morrison ..... B60P 7/0846 206/388
6,796,468 B1 * 9/2004 Nideborn ..... A45F 5/00 224/201
6,913,585 B2 * 7/2005 Salmon ..... A61F 5/026 128/874
7,235,731 B2 * 6/2007 Poff ..... G10G 5/005 84/274
7,544,871 B2 * 6/2009 Ringeride ..... G10G 5/005 84/280
8,079,116 B2 * 12/2011 Ayers ..... B60P 7/0869 150/154
8,631,984 B2 * 1/2014 Carlsson ..... A45F 3/14 224/259
D722,348 S * 2/2015 Kessler ..... D21/680
8,944,065 B2 * 2/2015 Slusarz, Jr. ..... A61B 5/0555 128/845
8,978,945 B2 * 3/2015 Komura ..... G10G 5/005 224/258
D726,264 S * 4/2015 Agate ..... D21/682
8,998,778 B2 * 4/2015 Potts ..... A63B 21/0724 482/104
9,044,081 B2 * 6/2015 McDonald ..... A45F 3/14
9,101,793 B1 * 8/2015 Kervin ..... A63B 21/065
D741,961 S * 10/2015 Maribona ..... D21/684
D752,160 S * 3/2016 Widerman ..... D21/684
9,373,312 B1 * 6/2016 Block ..... G10D 1/02
2005/0183564 A1 * 8/2005 Ripley ..... G10D 3/18 84/327
2006/0011688 A1 * 1/2006 Duncan ..... A45F 3/14 224/602
2006/0186635 A1 * 8/2006 Stewart ..... B60P 3/1033 280/414.3
2006/0243116 A1 * 11/2006 Chou ..... G10G 5/005 84/385 A
2007/0099774 A1 * 5/2007 Bruback ..... A63B 21/0602 482/105
2007/0184943 A1 * 8/2007 Davies ..... A63B 21/0724 482/93
2009/0084245 A1 * 4/2009 Harbaugh ..... G10G 5/005 84/327
2010/0293701 A1 * 11/2010 Gaffney ..... A41F 3/04 2/334
2011/0132171 A1 * 6/2011 Shaffer ..... G10D 3/06 84/293

(56) References Cited

U.S. PATENT DOCUMENTS

| | | | | |
|---|---|---|---|---|
| 2011/0203441 | A1* | 8/2011 | Naylor | G10G 5/005<br>84/327 |
| 2012/0046083 | A1* | 2/2012 | Klett | H04B 1/385<br>455/569.1 |
| 2013/0091668 | A1* | 4/2013 | Turdjian | A44B 11/06<br>24/579.11 |
| 2014/0054335 | A1* | 2/2014 | Morgan | A45C 11/00<br>224/222 |
| 2014/0085814 | A1* | 3/2014 | Kielland | A45F 3/02<br>361/679.55 |

* cited by examiner

ERGONOMIC SUPPORT APPARATUS

RELATED APPLICATION

This patent application claims benefit under 35 U.S.C. §119(e) of U.S. Provisional Patent Application No. 62/146,076, filed on Apr. 10, 2015, and U.S. Provisional Patent Application No. 62/166,592, filed on May 26, 2015 which are hereby incorporated by reference in their entireties.

BACKGROUND

Technical Field

The present disclosure relates to ergonomic support devices that can improve ergonomic posture and aid in injury prevention and, in particular, to ergonomic support devices for musical instruments.

Description of the Related Art

Instrumental musicians often struggle with balance, alignment, and posture. Some musicians, such as cellists and upright bass players, have the advantage that their instruments are supported by a post that transfers the weight of the instrument to the floor. Likewise, pianos and other large percussion instruments have legs that transfer the weight of the instrument to the floor. Some woodwind players such as saxophonists and bassoonists are known to use a lanyard to assist in supporting and positioning their instrument. Guitar players often use a strap to support the weight of a folk guitar or an electric guitar while playing.

In contrast, violins and violas are supported completely by the player, wherein the neck of the instrument is partly supported by the left hand and the body of the instrument is supported by the collarbone. The violin is then held in place by the weight of the player's chin, placed on the top of the instrument, directly over the collarbone.

Supporting the instrument properly is one of the main challenges involved in playing the violin. Even advanced and professional players are vulnerable to injuries caused by the strain of holding up the instrument. Although violins are typically more awkward than they are heavy, the weight of a viola can be significant and problematic. Most violinists and violists use accessories to aid in supporting their instruments. For example, a chinrest that clamps onto one end of the instrument provides a cup that keeps the chin in position. Players may also use a pad or shoulder rest to fill some of the space between the chin and the shoulder. A high-friction cloth can be used to prevent the instrument from slipping out of position. Players who have long necks may need a customized chinrest that is elevated several inches above the top of the instrument. Unfortunately, any such device that constrains or absorbs vibration of the instrument tends to interfere with tone production.

BRIEF SUMMARY

A specialized ergonomic apparatus in the form of a harness supports the weight of a violin or a viola, eliminating the need for the player to engage the neck or chin to support the instrument while playing. The harness transfers the weight of the instrument to larger muscles in the player's back, thus providing an ergonomic solution, and encouraging beneficial posture. Use of the violin harness permits playing freely, without a need for a chinrest or similar accessories. Furthermore, the player need not engage the chin or neck at all. Such an advantage may allow those with upper torso injuries, who might otherwise be prevented from playing the violin, to do so comfortably and painlessly.

In an embodiment, the violin harness includes a shoulder strap, a back strap, and an adjustable strap that attaches to the instrument. Various different attachment options are disclosed. In an embodiment, the shoulder strap is omitted, and the back strap connects to the player's belt, so that the harness is substantially invisible to an audience. In an embodiment, the back strap is omitted and the shoulder strap connects to a counterweight near the center of the player's back. The counterweight may be hidden in a pocket of the harness. In an embodiment, the counterweight may be a central element of the harness to which the straps are directly attached. Embodiments of the violin harness as shown and described herein can be used or adapted to support loads, other than musical instruments, that are carried in front of the wearer.

In use, a musician dons the harness, placing the shoulder strap over the right shoulder, and joining the back strap with the shoulder strap to form a closed loop. The third, adjustable, strap is then connected to the instrument. Such a connection may be made indirectly by first attaching the adjustable strap to an attachment mounted to the instrument.

DETAILED DESCRIPTION

Figure 1:
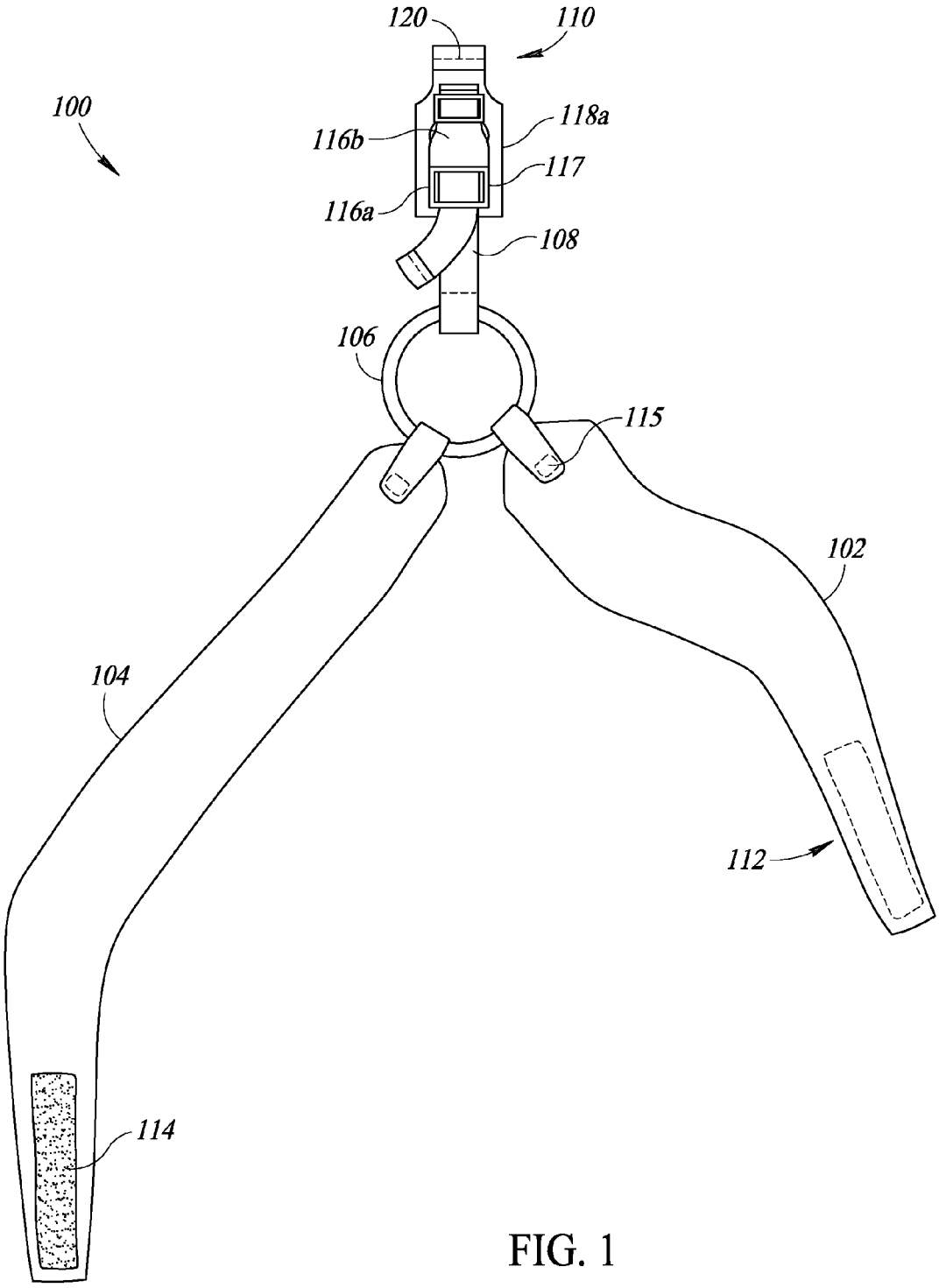
FIG. 1 is a pictorial view of a violin harness having anatomically contoured shoulder and back straps, according to an embodiment as described herein.

In the following description, certain specific details are set forth in order to provide a thorough understanding of various aspects of the disclosed subject matter. However, the disclosed subject matter may be practiced without these specific details. In some instances, well-known structures and methods comprising embodiments of the subject matter disclosed herein have not been described in detail to avoid obscuring the descriptions of other aspects of the present disclosure.

Unless the context requires otherwise, throughout the specification and claims that follow, the word "comprise" and variations thereof, such as "comprises" and "comprising" are to be construed in an open, inclusive sense, that is, as "including, but not limited to."

Reference throughout the specification to "one embodiment" or "an embodiment" means that a particular feature, structure, or characteristic described in connection with the embodiment is included in at least one embodiment. Thus, the appearance of the phrases "In an embodiment" or "in an embodiment" in various places throughout the specification are not necessarily all referring to the same aspect. Furthermore, the particular features, structures, or characteristics may be combined in any suitable manner in one or more aspects of the present disclosure.

In the drawings, identical reference numbers identify similar elements or acts unless the context indicates otherwise. The sizes and relative positions of elements in the drawings are not necessarily drawn to scale.

Specific embodiments are described herein with reference to violin harnesses that have been produced; however, the present disclosure and the reference to certain materials, dimensions, and the details and ordering of processing steps are exemplary and should not be limited to those shown.

Figure 2:
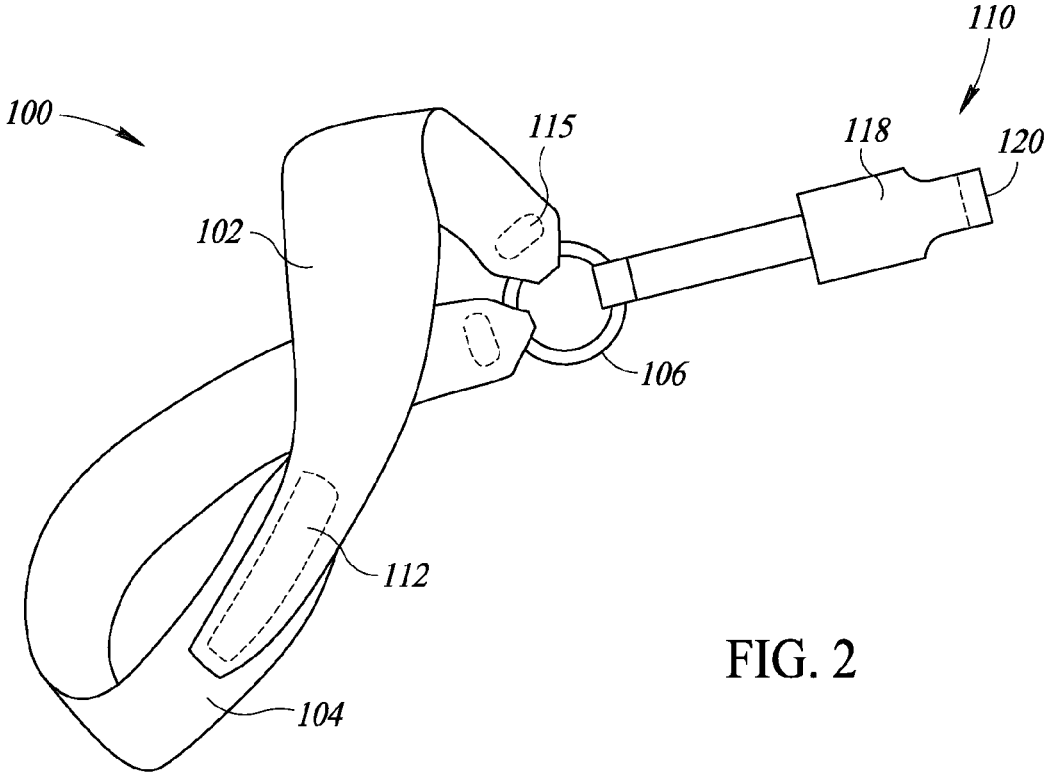
FIG. 2 illustrates adjustable closure of the violin harness shown in FIG. 1, forming a closed loop.

FIGS. 1-3, 4A, and 4B show a violin harness 100, according to an embodiment. The violin harness 100 includes an anatomically contoured back strap 102, an anatomically contoured shoulder strap 104, a coupling device such as a coupling ring 106, an adjustable length strap 108, and a connector assembly 110 that connects the violin harness 100 to a musical instrument, e.g., a violin or a viola. As shown in FIG. 1, the anatomically contoured straps 102, 104 are curved and have widths that vary along their lengths to fit the human form so that the violin is supported ergonomically. The violin harness 100 fits around a wearer, such that the back strap 102 and the shoulder strap 104 connect to form a closed loop as shown in FIG. 2, using an adjustable closure device such as, for example, a Velcro™ hook and loop closure 112/114. The straps 102, 104, and 108 can be made of a durable fabric, leather, or any other suitable material.

Figure 3:
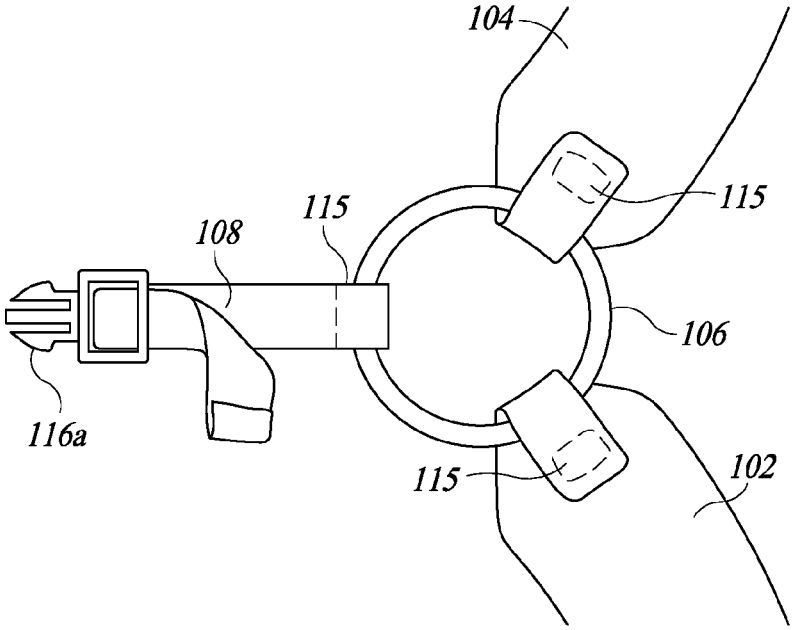
FIG. 3 is a magnified view of a coupling ring that joins various straps of the violin harness shown in FIG. 1.

FIG. 3 shows a magnified view of the coupling ring 106, according to an embodiment. The coupling ring 106 serves as an automatic adjustment mechanism for orienting the straps 102, 104, and 108, relative to one another. The straps are attached to the coupling ring 106 by loops 115. The coupling ring 106 may be made of metal, plastic, or carbon fiber, for example. The coupling ring may be anodized and may have a color that matches the straps 102, 104, 108. Alternatively, another type of coupling device may be used in place of a ring. The coupling ring 106, however, advantageously allows the straps 102, 104, and 108 to self-adjust so as to facilitate assuming the most comfortable and ergonomically desirable positions relative to one another.

Figure 4A:
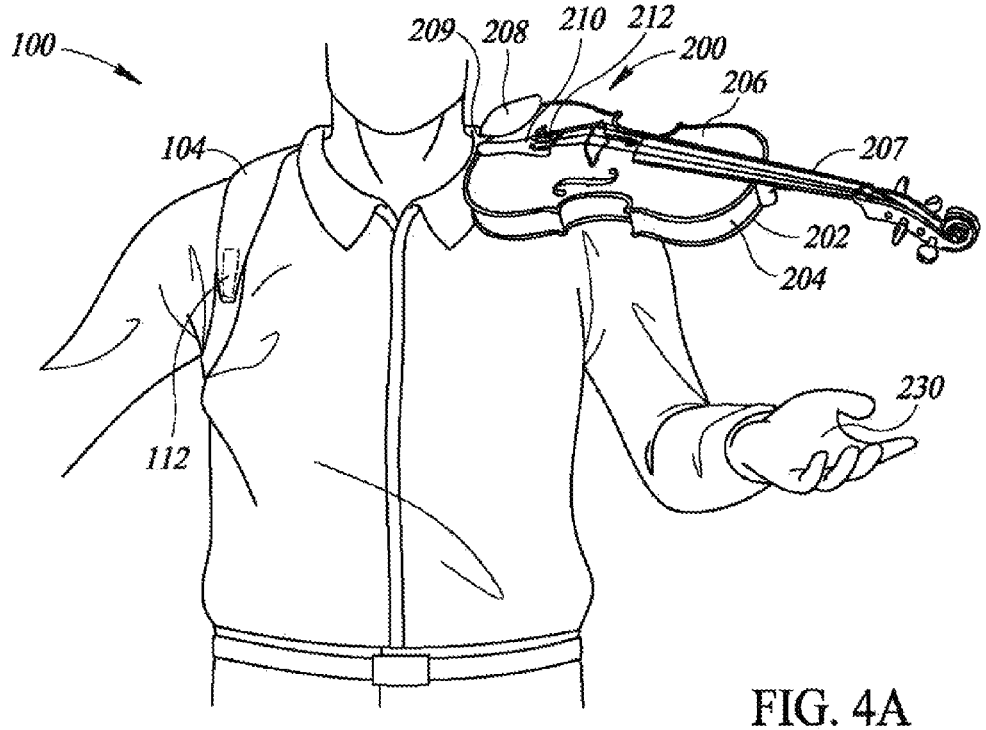
FIG. 4A is a front view of the violin harness shown in FIG. 1 when fitted to a wearer.
Figure 4B:
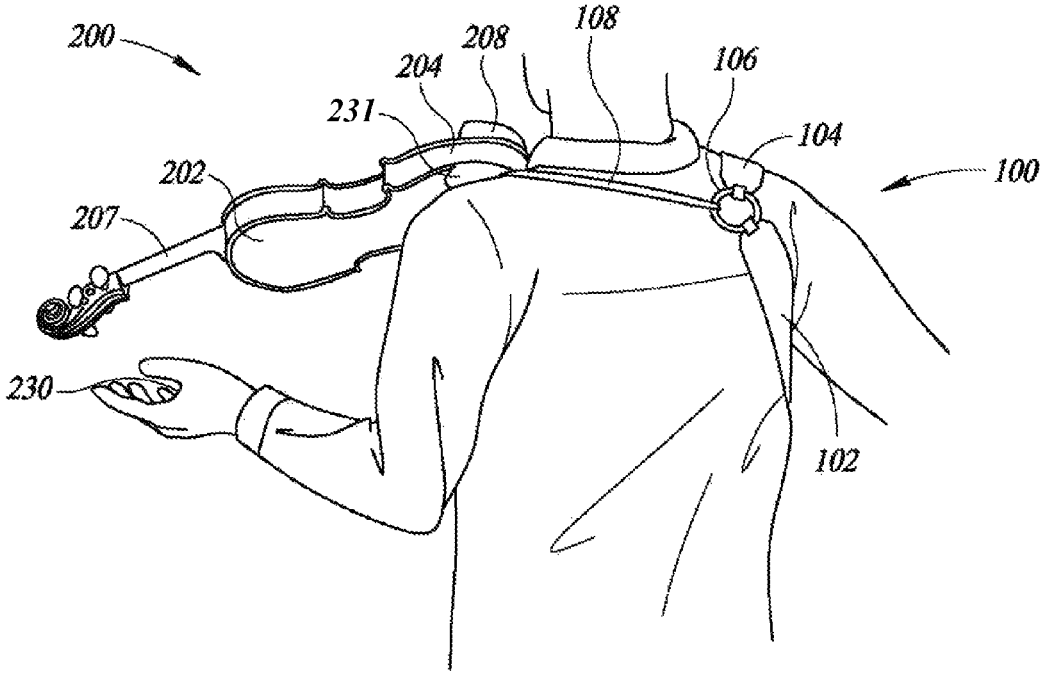
FIG. 4B is a back view of the violin harness shown in FIG. 1 when fitted to a wearer.

FIGS. 4A and 4B show the violin harness 100 connected to a violin 200, while being worn by a violin player. It is noted that a viola generally may be substituted for the violin 200. The violin 200 includes a back 202, ribs 204, a top 206, and a neck 207, typically made of wood, although other materials may be used such as, for example, carbon fiber. With reference to FIG. 4A, accessories to the violin 200 include a chinrest 208 that rests on a chinrest foot 209, a tailpiece 210, and one or more fine tuners 212. As shown in FIG. 4A, the violin harness 100 fully supports the weight of the violin 200 so that the player's left hand 220 is free. That is, the player's left hand 220 need not touch the instrument, and still, the neck 207 and the strings are maintained substantially parallel to the ground in proper playing position. The player may optionally use a shoulder rest 231, which is placed between the back 202 and the player's shoulder. As shown in FIG. 4B, the coupling ring 106 is positioned in contact with the wearer's back. The closed loop fits under the wearer's right arm, and the adjustable length strap 108 extends over the left shoulder to connect with the instrument via the connector assembly 110. The violin harness 100 is substantially invisible to an audience when the player wears a jacket, which is often the case in a music performance.

Figure 4C:
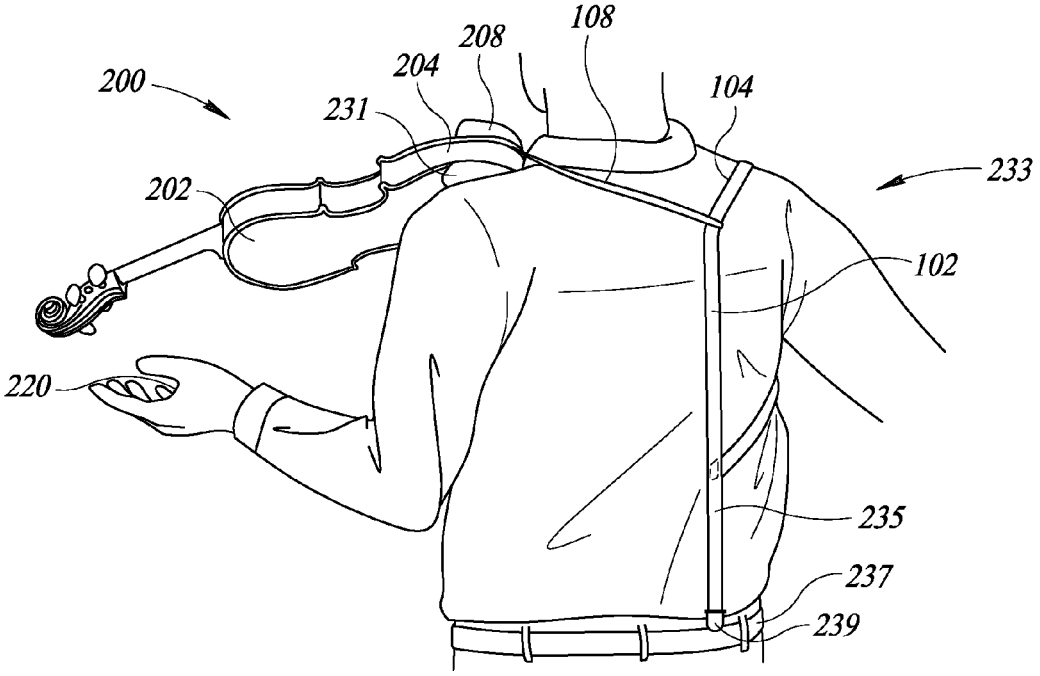
FIG. 4C is a back view of a violin harness in use, according to an embodiment as described herein.

FIG. 4C shows a violin harness 233 connected to a violin 200, while being worn by a violin player, according to an embodiment. The violin harness 233 omits the coupling ring 106 and substitutes a back strap 235 that attaches to the player's belt 237 using a clip 239. The belt 237 assists in supporting the weight of the instrument. However, the violin harness 233 may be somewhat less flexible than the violin harness 100 because, unlike the coupling ring 106, the back strap 235 may not shift its position to automatically compensate for movement of the wearer.

Figure 5A:
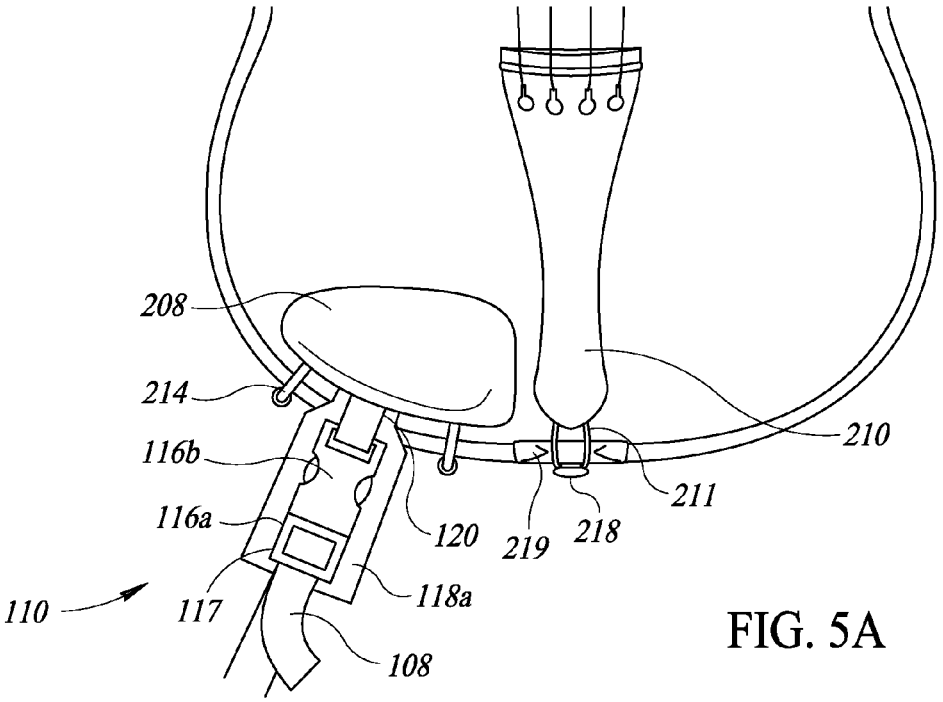
FIG. 5A is a top plan view showing attachment of a violin harness connector to a violin chinrest, according to an embodiment as described herein.
Figure 5B:
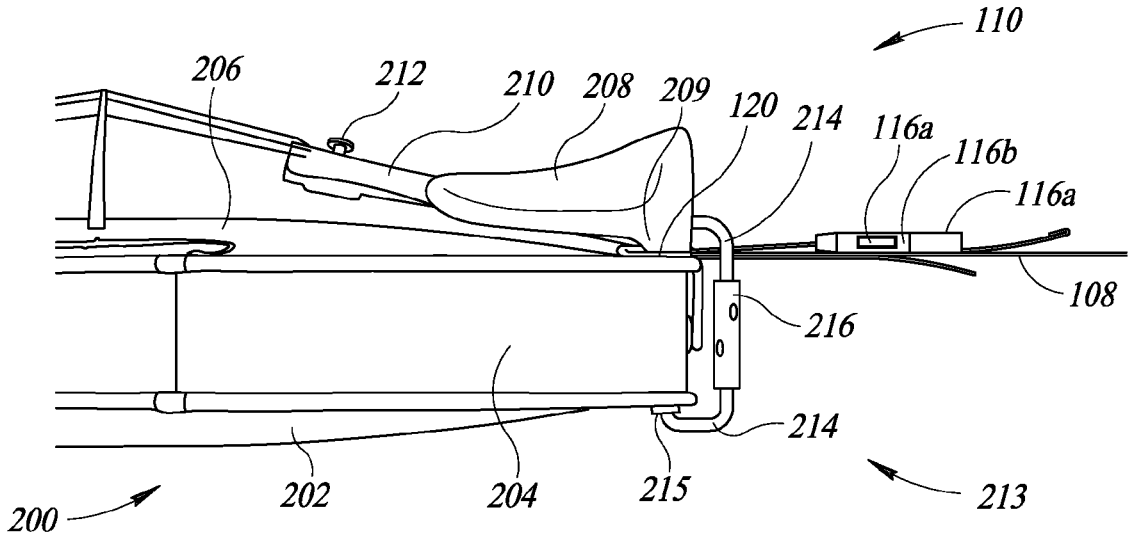
FIG. 5B is a side elevation view showing the attachment arrangement of FIG. 5A.

FIGS. 5A and 5B show magnified views of the connector assembly 110, according to an embodiment. The connector assembly 110 includes a two-part clip having a male portion 116*a* that fits into a female portion 116*b*. The two-part clip removably connects to the adjustable length strap 108. A buckle 117 facilitates adjusting the length of the adjustable length strap 108. The connector assembly 110 also includes a protective flap 118*a* that prevents contact between the buckle 117 and the instrument. The protective flap 118*a* can be made of fabric, leather, e.g., chamois, or any other suitable material that will not harm the polished wood finish of the instrument.

FIGS. 5A and 5B show in greater detail how the connector assembly 110 is secured to a violin 200. It may be advantageous to secure the violin harness 100 to an accessory instead of directly to the violin 200 so as not to alter the violin 200, itself, in any way, which may compromise its value. For example, the connector assembly may be connected to the chinrest 208 as described below. The chinrest 208 is attached to the violin 200 by a chinrest clamp 213. The chinrest clamp 213 includes threaded rails 214, a lower plate 215, and a barrel screw 216 having screw holes 217. The chinrest foot 209 contacts the top 206 of the instrument and is held in place by the chinrest clamp 213 by tightening the barrel screw 216. The threaded rails 214 are mounted in the side of the chinrest 208 and are therefore an integral part of the chinrest 208. The lower plate 215 of the chinrest clamp 213 contacts the back 202. The end 120 of the adjustable length strap 108 may be attached to the violin 200 simply by loosening the barrel screw 216, sliding the end 120 underneath the chinrest foot 209, and re-tightening the barrel screw 216. The end 120 may be made thicker than the rest of the adjustable length strap 108 so the end 120 will not pull out from under the chinrest foot 209.

Figure 6:
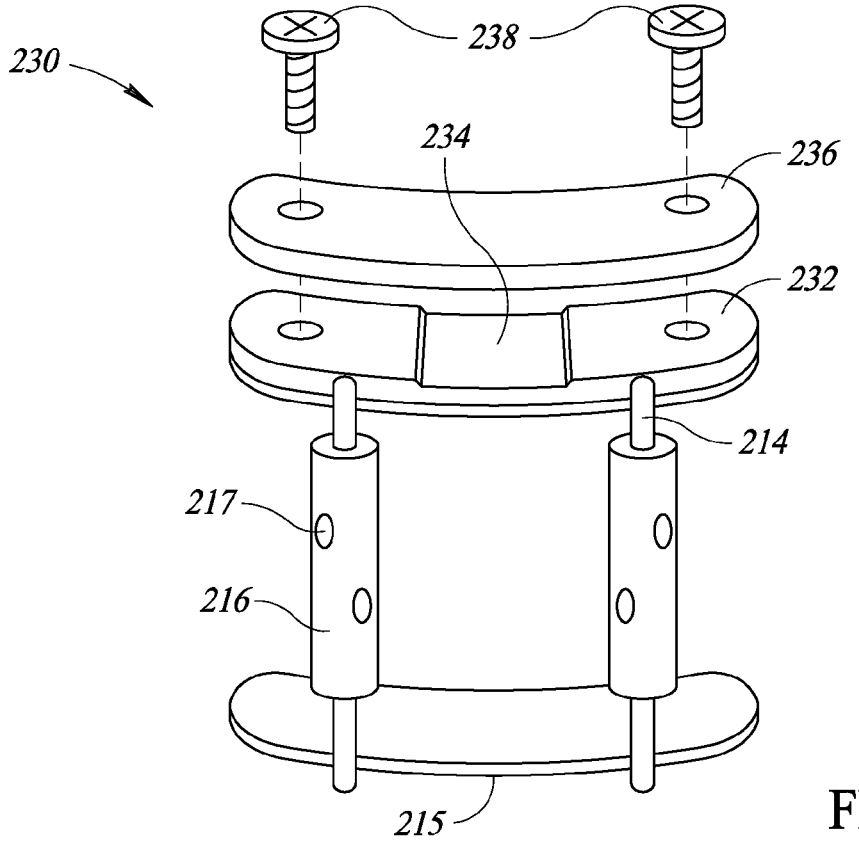
FIG. 6 is an exploded view of a strap clamp, according to an embodiment as described herein.
Figure 7:
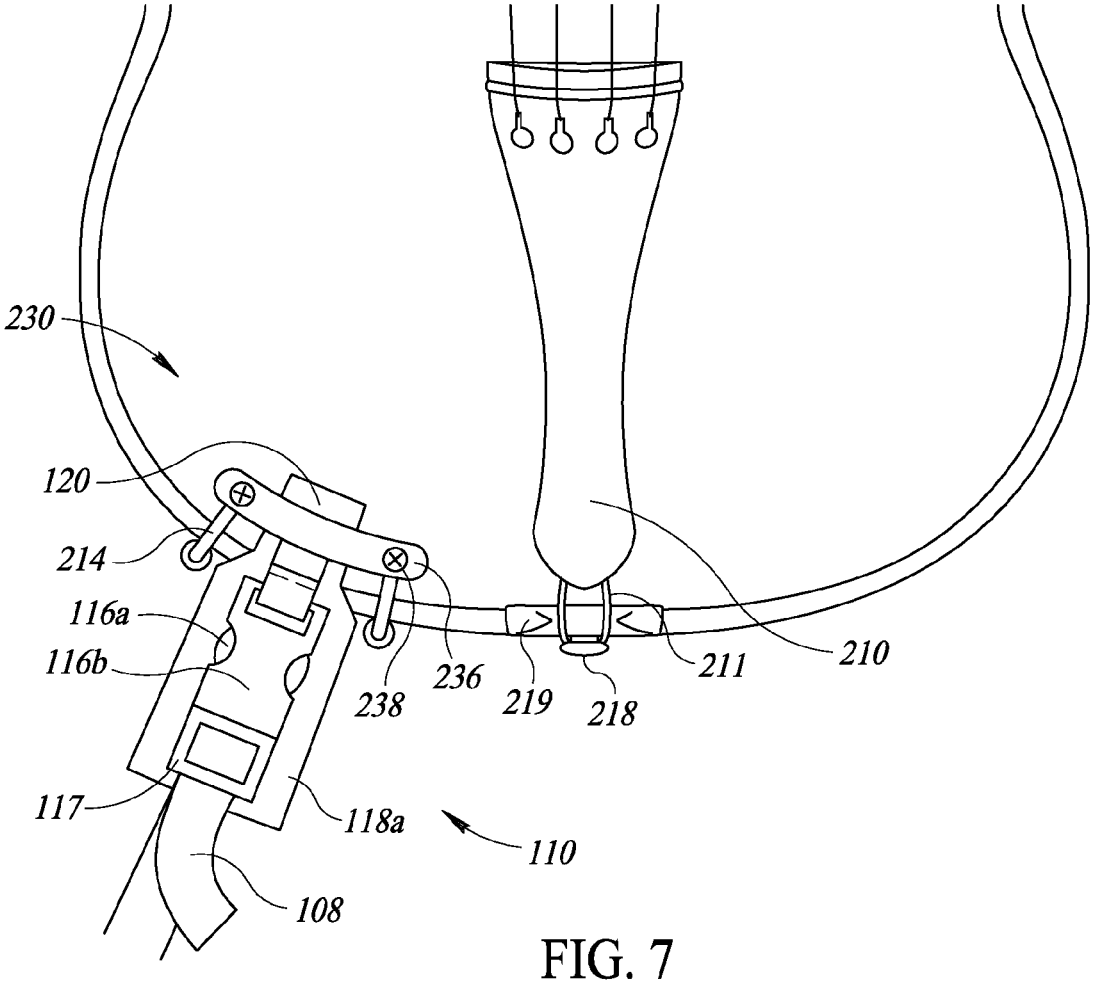
FIG. 7 is a top plan view showing attachment of a violin harness connector to the strap clamp shown in FIG. 6.

FIGS. 6 and 7 illustrate a strap clamp 230 that secures the adjustable strap 208 in place of a chinrest, according to an embodiment. The strap clamp 230 includes the threaded rails 214, the lower plate 215, and the barrel screw 216, as well as a base plate 232, a top plate 236, and screws 238. The threaded rails 214 of the strap clamp 230 are mounted to a base plate 232 having an indentation 234 that accommodates the adjustable strap 208. The top plate 236 exerts pressure against the base plate 232 and the adjustable strap 208 when the screws 238 are tightened.

FIGS. 8-22 show magnified views of alternative designs for the connector assembly 110 of the embodiment of FIG. 1, with various options for connecting the violin harness 100 to an instrument via a connection apparatus. Some embodiments of the connection apparatus include the connector assembly 110 as well as additional hardware mounted to the instrument to receive the connector assembly 110. Some embodiments of the connection apparatus replace the connector assembly 110. Detailed descriptions of the various embodiments are presented below. One reason that alternative designs are presented is that players may or may not use various ones of the violin accessories. In addition, accessories such as the chinrest 208 are available in many different styles and shapes.

In particular, embodiments shown in FIGS. 8-22 are concerned with different connectors and points of connection used to removably attach the adjustable length strap 108 to the violin. The connector itself can take on various different forms. For example, in the connector assembly 110, the connector is the male portion 116*a* of a plastic clip that includes a short length of strapping material. The buckle 117 may be provided with a pliable backing that protects the instrument from contacting the buckle. The backing itself may wrap around the connection point, e.g., a clamp or a bracket. Alternatively, the short length of strap attached to the buckle 117 may attach to the connection point. Additionally or alternatively, the connector may include a push-button quick-release mechanism so that when the violin harness is disconnected, no elements related to the harness or its connection apparatus protrude from the instrument.

In some embodiments the connector assembly attaches to the chinrest 208 or to the chinrest clamp 213; in other embodiments, the connector assembly attaches to the endpin or "button" 218, which is mounted in a hole in the rib 204 of the violin. It is noted that the tail gut 211 wraps around the button 218, securing the tailpiece 210. The button 218 is therefore already under a high degree of tension from the strings and the tailpiece 210. In some embodiments, string tension on the button may be balanced by opposing tension due to the violin harness 100. In another embodiments, the chinrest 208 is removed, but the chinrest clamp 213 is retained as part of the connection apparatus of the violin harness 100. In an embodiment, a strut is mounted over the button 218 for attachment to the chinrest clamp 213. The strut then receives an end of the adjustable length strap 108 or an end of the protective flap 118*a*.

Figure 8:
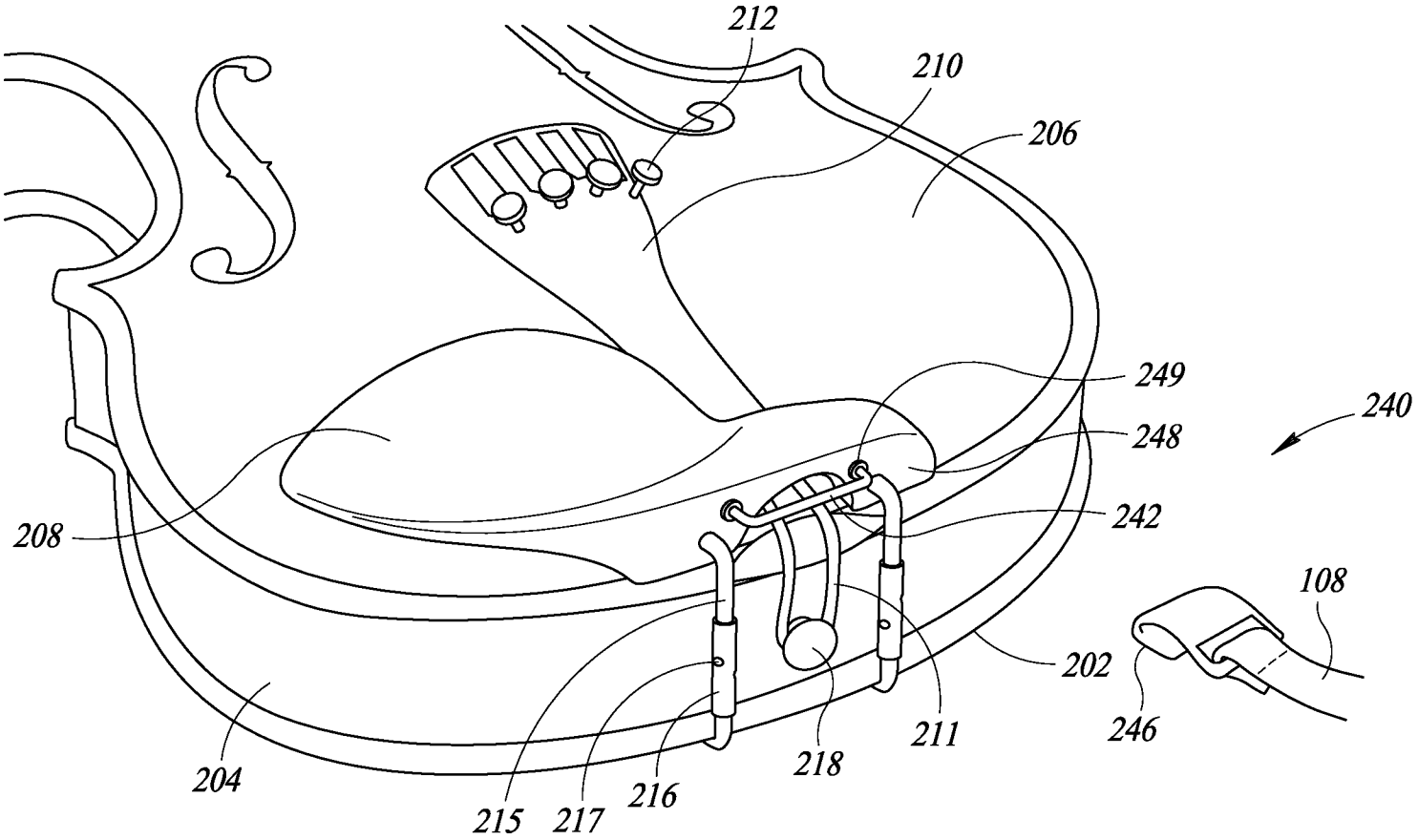
FIG. 8 is a magnified view of a connection apparatus that attaches the adjustable strap of a violin harness to the violin, according to an embodiment described herein.

FIG. 8 shows a connection apparatus 240, according to an embodiment. The connection apparatus 240 is compatible with an exemplary chinrest that straddles the end of the tailpiece and therefore does not have a unitary chinrest foot 209, e.g., a Guarneri style chinrest. The connection apparatus 240 includes a bracket 242 affixed to a sidewall 248 of the chinrest 208 and a hook 246 attached to the end of the adjustable length strap 108. The bracket 242 may attach to the sidewall 248 using fasteners 249. The bracket 242 may be made of metal, for example. The hook 246 may be made of a strong plastic material and may be curved so that it wraps around the bracket 242 securely. A clip or any other suitable fastener may be substituted for the hook 246.

Figure 9:
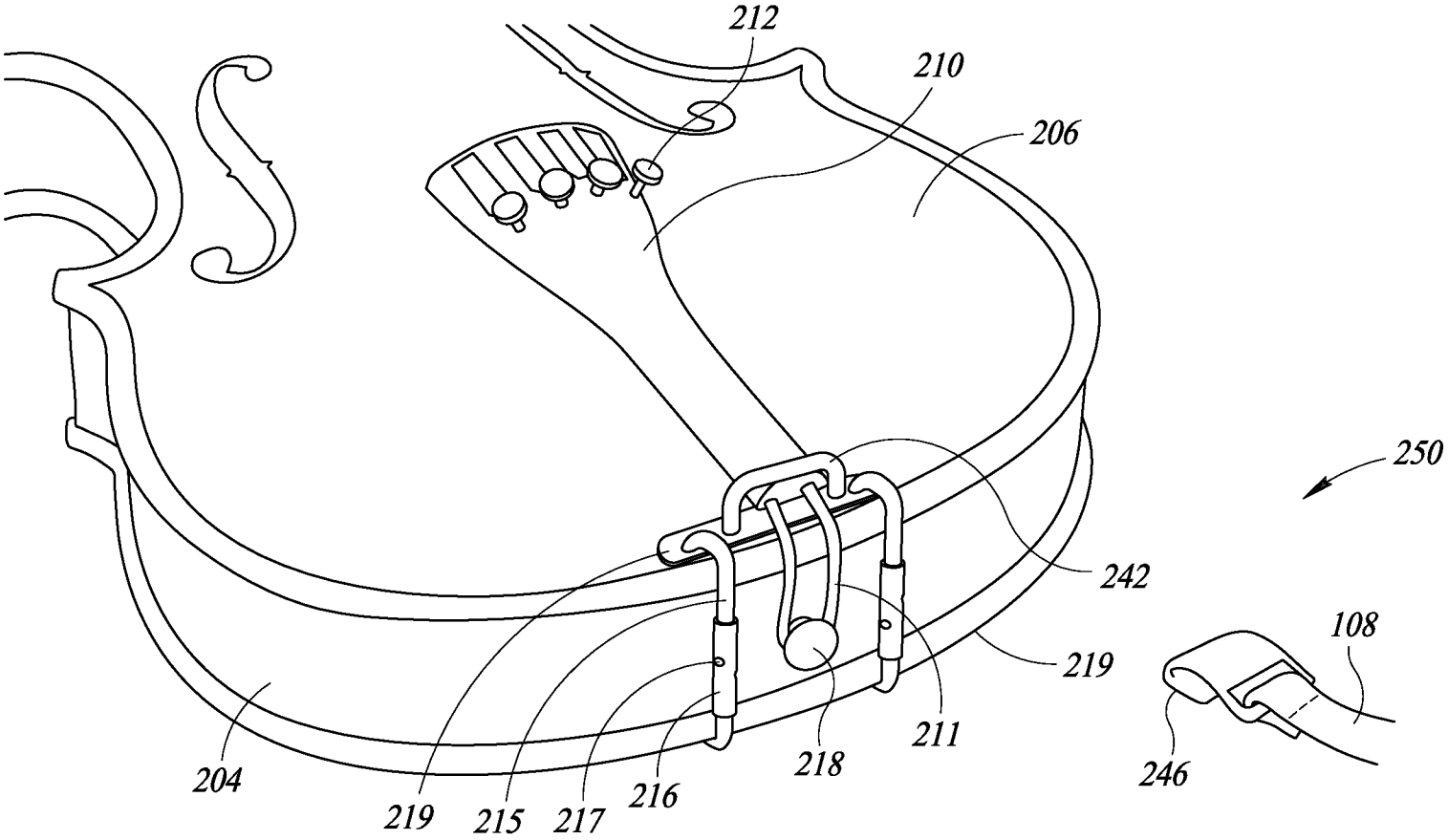
FIG. 9 is a magnified view of a connection apparatus that attaches the adjustable strap to the violin, according to an embodiment described herein.

FIG. 9 shows a connection apparatus 250, according to an embodiment. The connection apparatus 250 is similar to the connection apparatus 240, except that the connection apparatus 250 may be used without a chinrest 208 entirely. Instead of mounting the bracket 242 to a chinrest, the bracket 242 may be mounted to the saddle 219.

Figure 10:
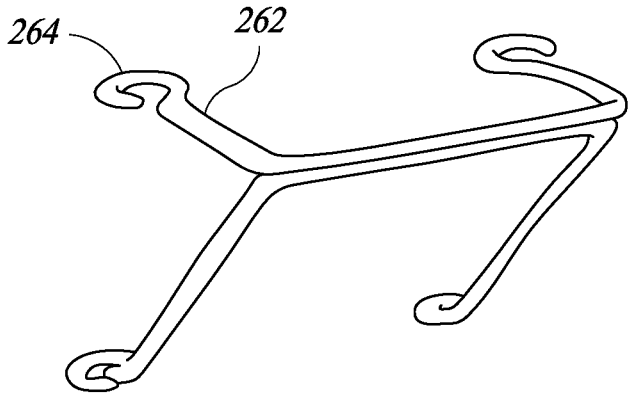
FIGS. 10 and 11 are perspective views of a bracket that permits attachment of the adjustable strap to a violin chinrest, according to an embodiment as described herein.
Figure 11:
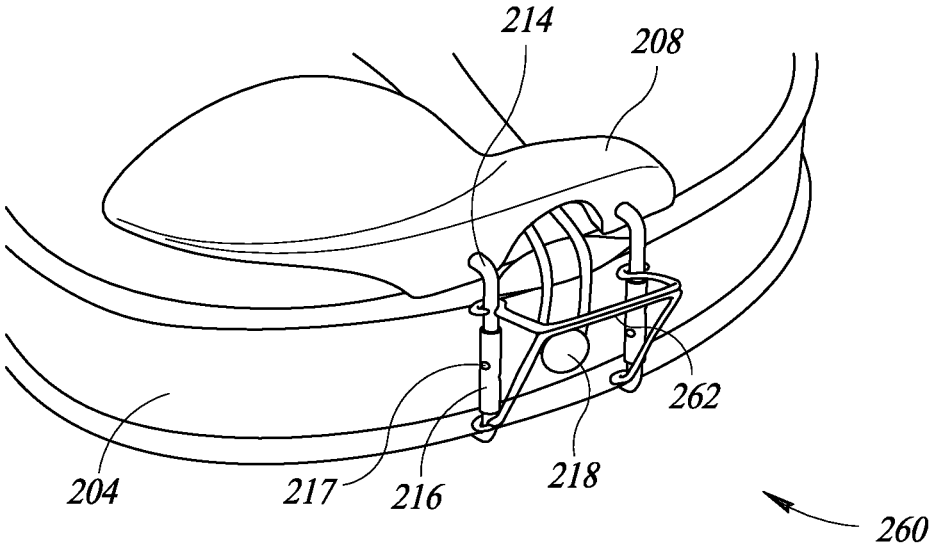

FIGS. 10 and 11 show a connection apparatus 260, according to an embodiment. The connection apparatus 260 is similar to the connection apparatus 240, except that the connection apparatus 260 features a chinrest clamp bracket 262 that attaches to the chinrest clamp 213 instead of to the sidewall 248. For example, the chinrest clamp bracket 262 may include a plurality of hooks 264 (four shown) that wrap around the rails 214 of the chinrest clamp 213.

Figure 12:
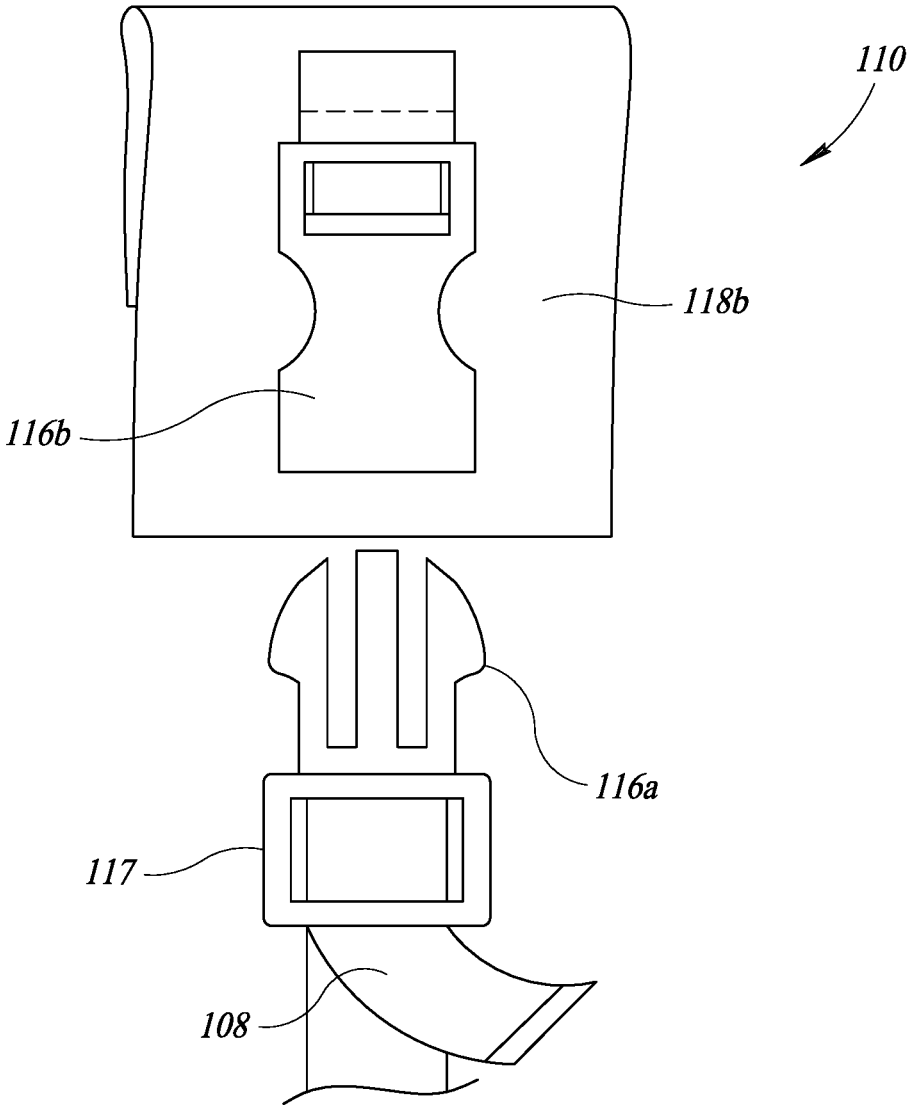
FIG. 12 is a magnified view of a connection apparatus that attaches the adjustable strap to the violin, according to an embodiment as described herein.

FIG. 12 shows a magnified view of the connector assembly 110 with the clip removed, exposing the male portion 116*a*. Such two-part clips 116*a*, 116*b* are well known. In FIG. 12, the exemplary protective flap 118*b* folds over and has a slightly different shape than the protective flap 118*a* shown in FIG. 1. The protective flap 118*b* can be used as part of the connection apparatus 260 to connect the violin harness 100 to the chinrest clamp bracket 262.

Figure 13:
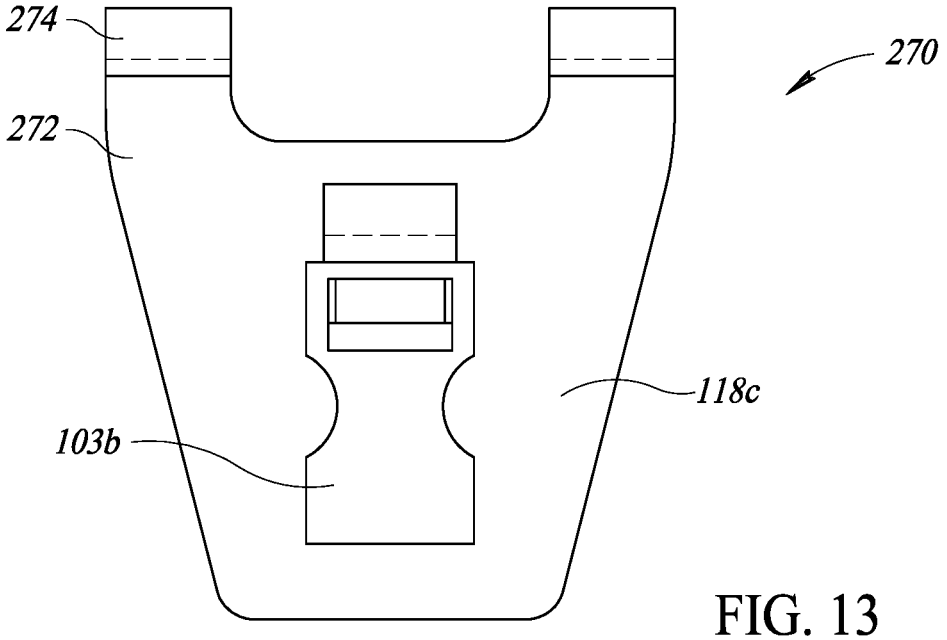
FIG. 13 is a top plan view of a connection apparatus that attaches the adjustable strap to the violin, according to an embodiment as described herein.
Figure 14:
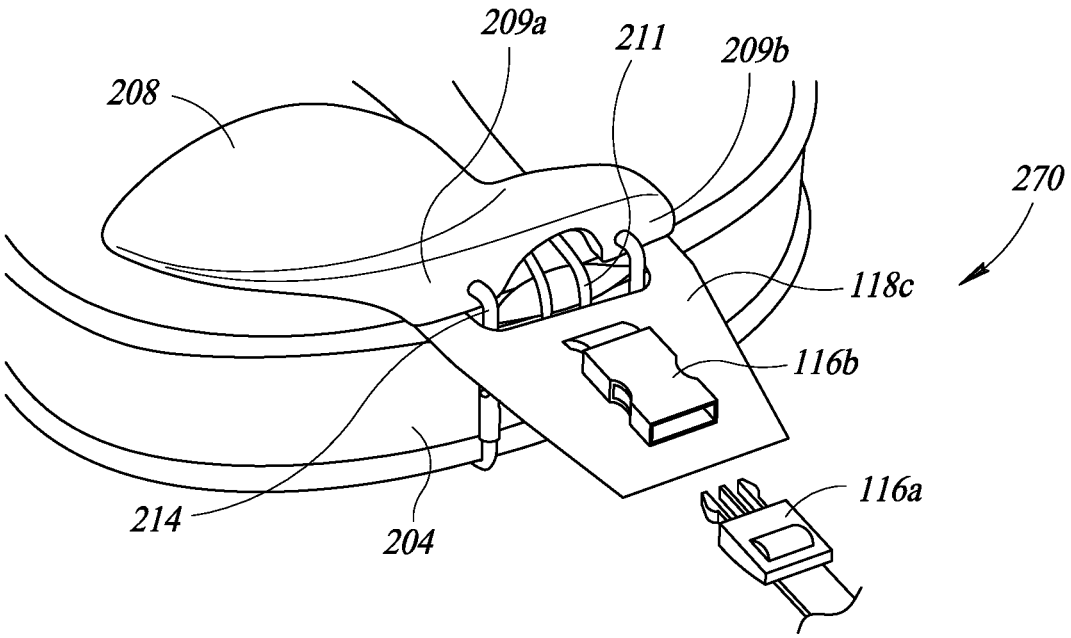
FIG. 14 is a perspective view of the connection apparatus shown in FIG. 13, when mounted to the violin.

FIGS. 13 and 14 show a connection apparatus 270, according to an embodiment. The connection apparatus 270 has a protective flap that is compatible with a Guarneri style chinrest. The connection apparatus 270 is similar to the connector assembly 110, except that the connection apparatus 270 features a protective flap 118*c* shaped like a "Y," having two ends 274 that are secured under respective chinrest feet 209*a*, 209*b*. The connection apparatus 270 has the additional advantage that it does not require additional mounting hardware to be installed on the chinrest 208, the chinrest clamp 213, or the saddle 219.

Figure 15:
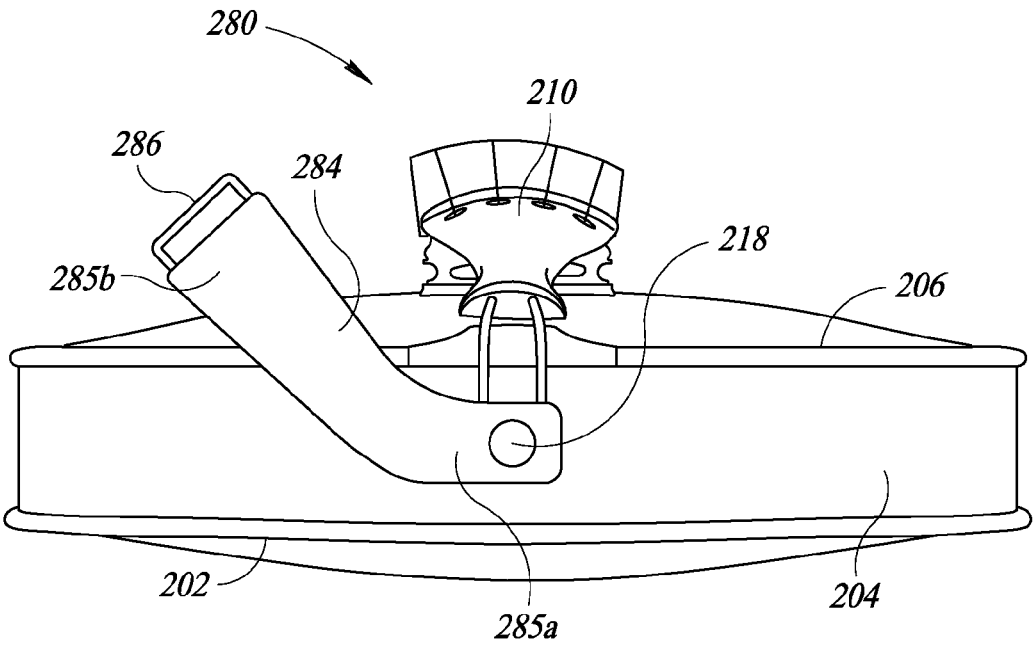
FIG. 15 is an end view of a violin to which a connection apparatus is attached at the button, according to an embodiment as described herein.
Figure 16:
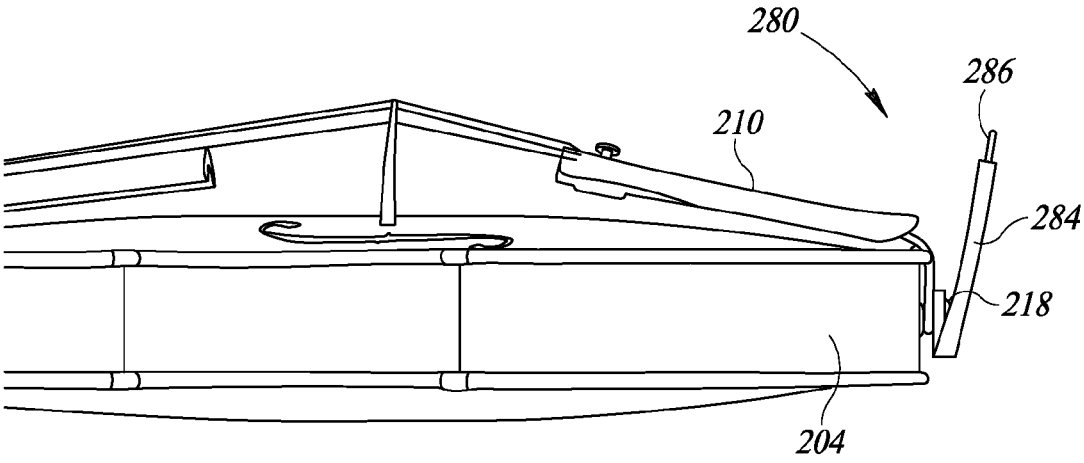
FIG. 16 is a side elevation view of the violin and the connection apparatus shown in FIG. 15.
Figure 17:
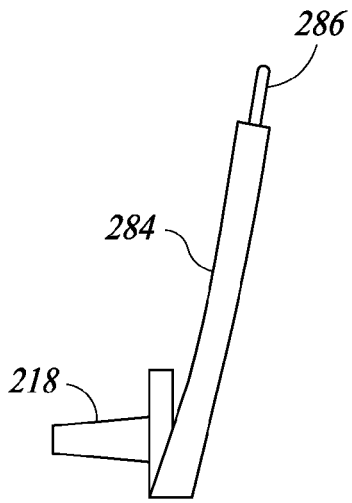
FIG. 17 is a magnified side view of the connection apparatus shown in FIGS. 15 and 16.

FIGS. 15, 16, and 17 illustrate a connection apparatus 280, according to an embodiment. The connection apparatus 280 can be used with or without the chinrest 208. The connection apparatus 280 includes an angled strap 284 and a U-shaped attachment bar 286. A narrow end 285*a* of the angled strap 284 is secured to the instrument at the button 218. In an embodiment, the angled strap 284 and the button are fabricated as a unitary device. The U-shaped attachment bar 286 is attached to a wide end 285*b* of the angled strap 284. The U-shaped attachment bar may desirably be made of a rigid material such as metal or plastic. The angled strap 284 desirably may be made of a soft material, e.g., fabric or leather.

Figure 18:
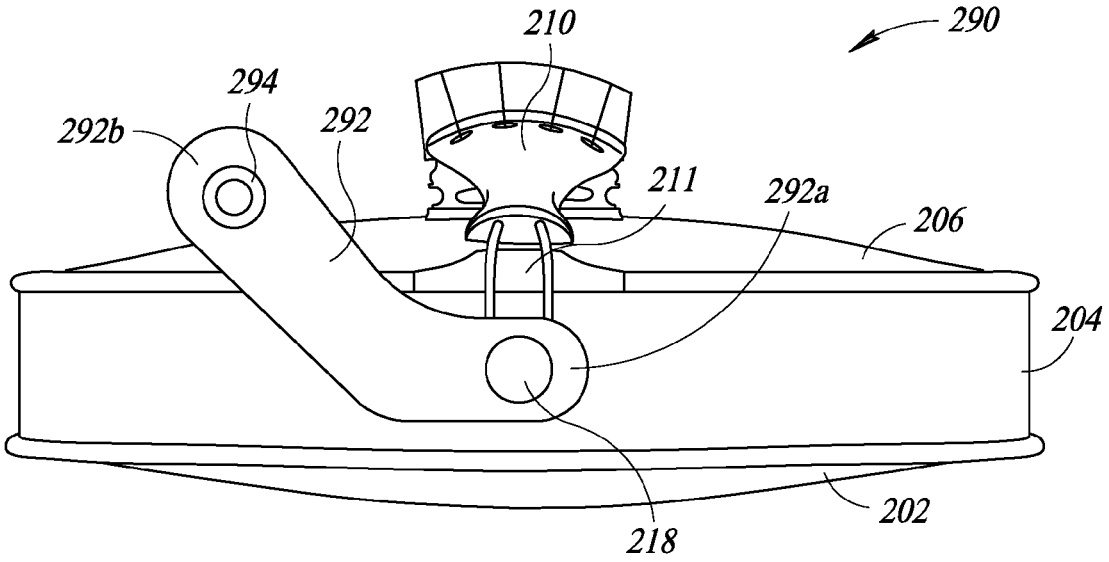
FIG. 18 is an end view of a violin to which a connection apparatus is attached at the button, according to an embodiment as described herein.
Figure 19:
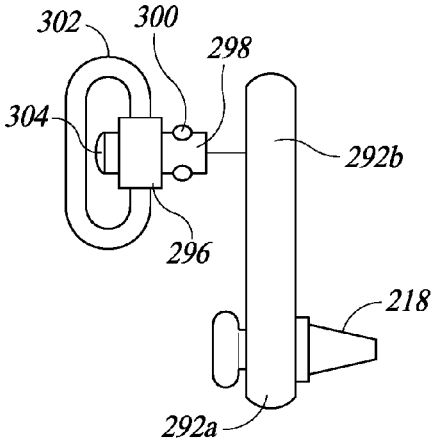
FIG. 19 is a side elevation view of the button and the connection apparatus shown in FIG. 18, equipped with a quick release swivel ring.

FIGS. 18 and 19 illustrate a connection apparatus 290, according to an embodiment. The connection apparatus 290 includes an angled strap 292 and a grommet 294. A narrow end 292*a* of the angled strap 292 is secured to the instrument at the button 218. In an embodiment, the angled strap 292 and the button 218 are fabricated as a unitary device. The angled strap 284 desirably may be made of a soft material, e.g., fabric or leather. The grommet 294 is positioned at a wide end 292*b* of the angled strap 292 to receive a quick release swivel ring 296. The quick release swivel ring 296 is in turn attached to an end of the adjustable length strap 108. The quick release swivel ring 296 includes a shaft 298, a plurality of ball detents 300, a ring 302, and a push button 304. The pushbutton 304 controls the position of the ball detents 300 relative to a surface of the shaft 298. When the push button 304 is depressed, the ball detents 300 retract into the shaft 298, permitting the shaft 298 to be inserted into the grommet 294. The push button 304 is then released, causing the ball detents 300 to extend out from the shaft 298, so that the shaft is retained in the grommet 294. Such a quick release swivel ring 296 is known in the art and is commercially available.

Figure 20:
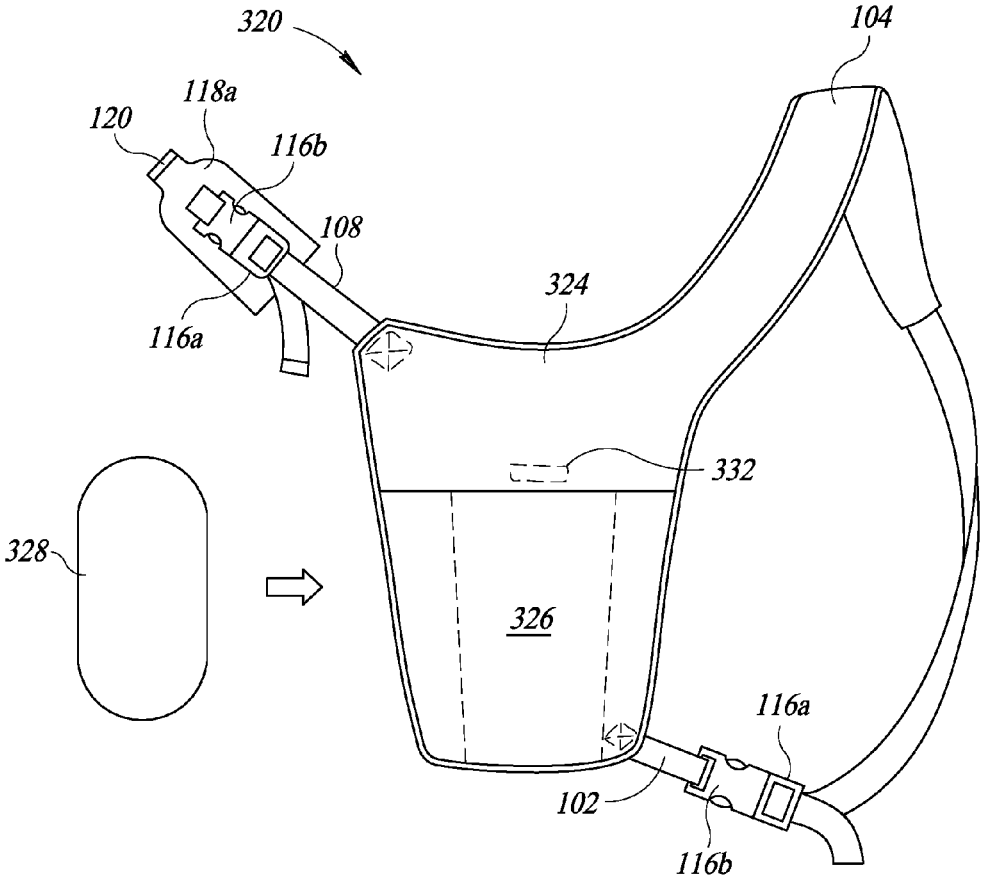
FIG. 20 is a pictorial view of a violin harness having an anatomically contoured shoulder strap and a pocket that accommodates a counterweight, according to an embodiment as described herein.
Figure 21:
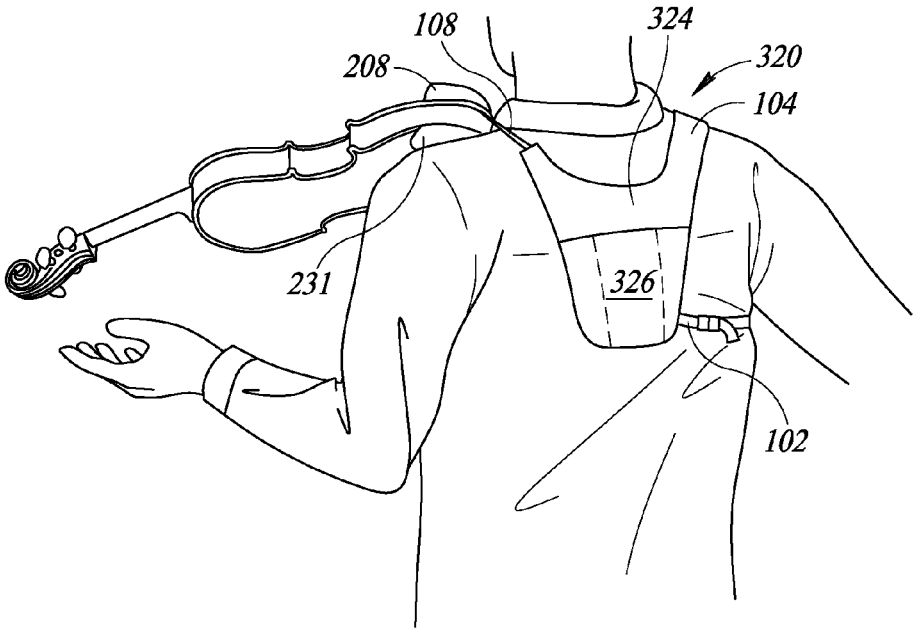
FIG. 21 is a back view of the violin harness shown in FIG. 20, when fitted to a wearer.
Figure 22:
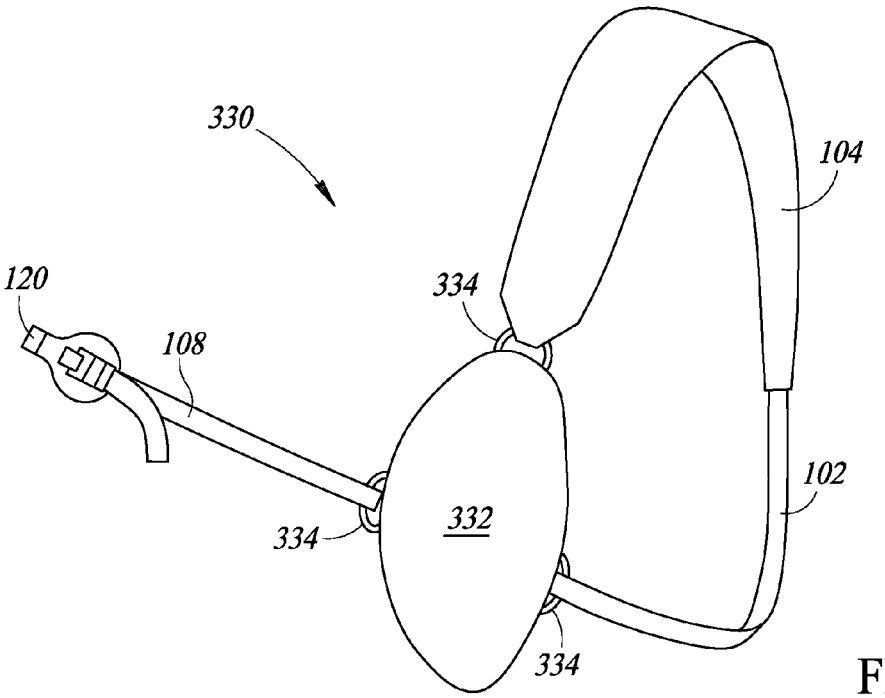
FIG. 22 is a pictorial view of a harness having an anatomically contoured shoulder strap and a coupler in the form of a counterweight, according to an embodiment as described herein.
Figure 23:
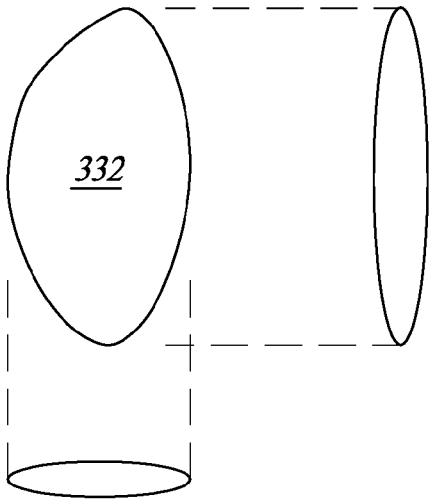
FIG. 23 is a pictorial view of the counterweight shown in FIG. 22.
Figure 24:
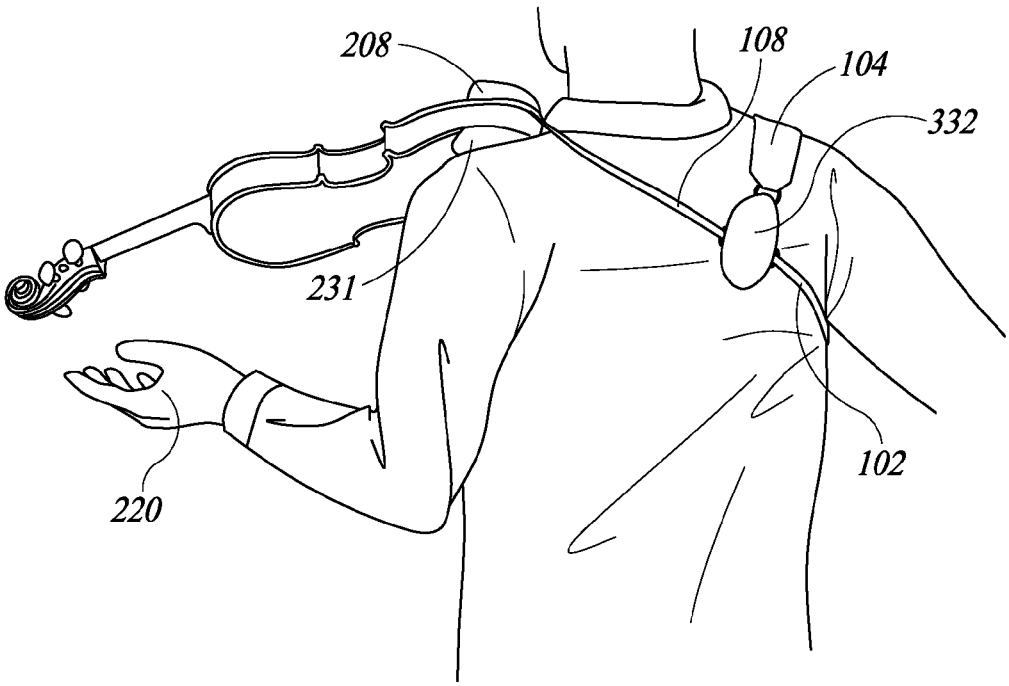
FIG. 24 is a back view of a person wearing the violin harness having the counterweight feature, as shown in FIG. 22, wherein the harness is fully supporting the violin.

FIGS. 20 and 21 illustrate a violin harness 320, according to an embodiment. The violin harness 320 includes the anatomically contoured shoulder strap 104 and, in place of a coupling ring 106, provides a panel 324 that contains a pocket 326 for holding a counterweight 328 against the player's back as shown in FIG. 21. The pocket 326 may have a pocket closure 332, e.g., made of Velcro™. The counterweight 328 supports the instrument by balancing the weight of the instrument while holding the instrument in a correct playing position. Consequently, the counterweight 328 may eliminate the need for the chinrest 208, the shoulder rest 231, or both. The counterweight 328 can be, for example, a contiguous solid weight, or a plurality of weights that can change position within the pocket 326 in accordance with the player's motion. The counterweight 328 may be in the form of, for example, a distributed weight such as steel shot held together in a fabric bag. The violin harness 320 can attach to the violin 200 using any one of the connectors described above for use with the violin harness 100, or combinations of such connectors.

Figure 25:
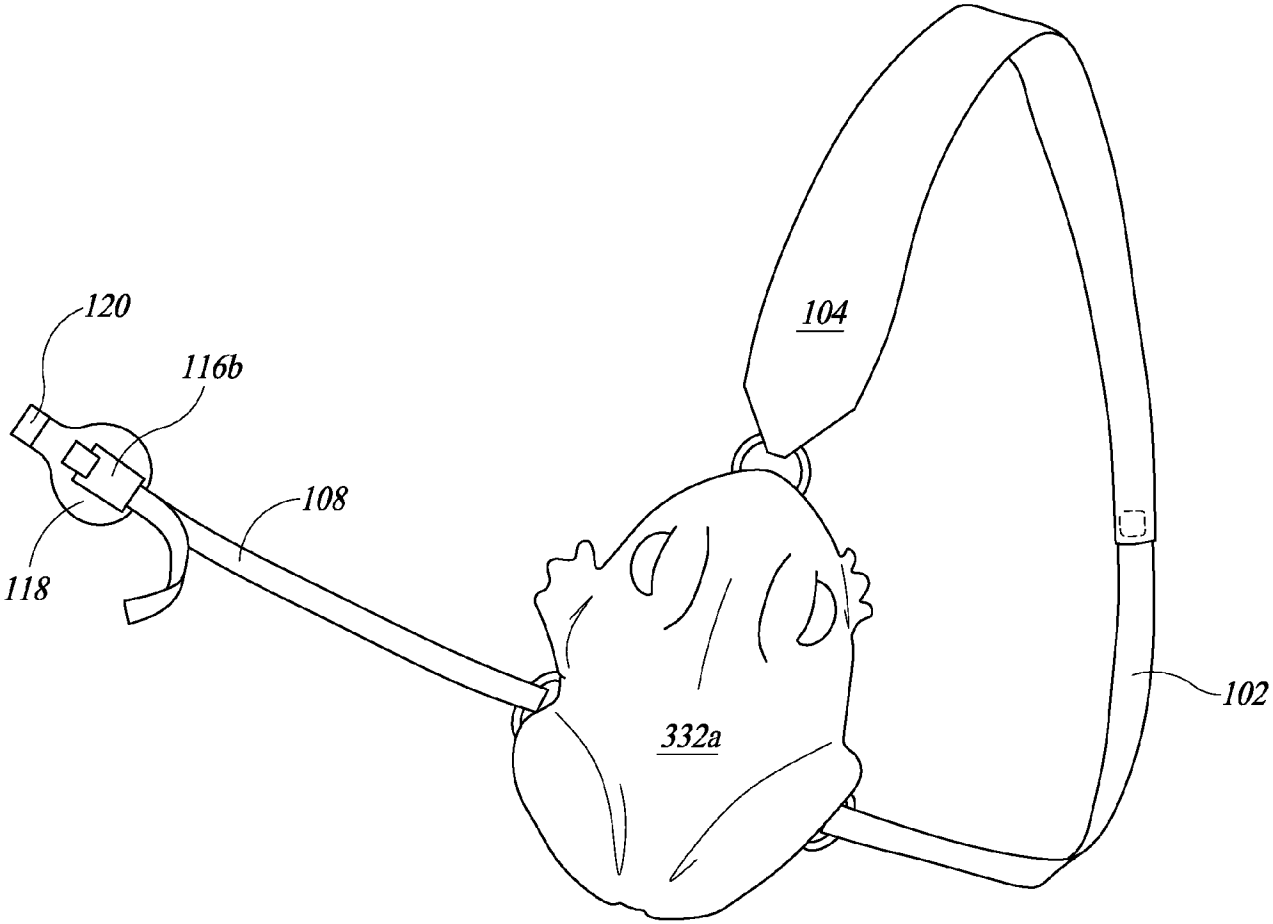
FIGS. 25-27 show examples of decorated counterweights for use with the violin harness shown in FIG. 22.
Figure 26:
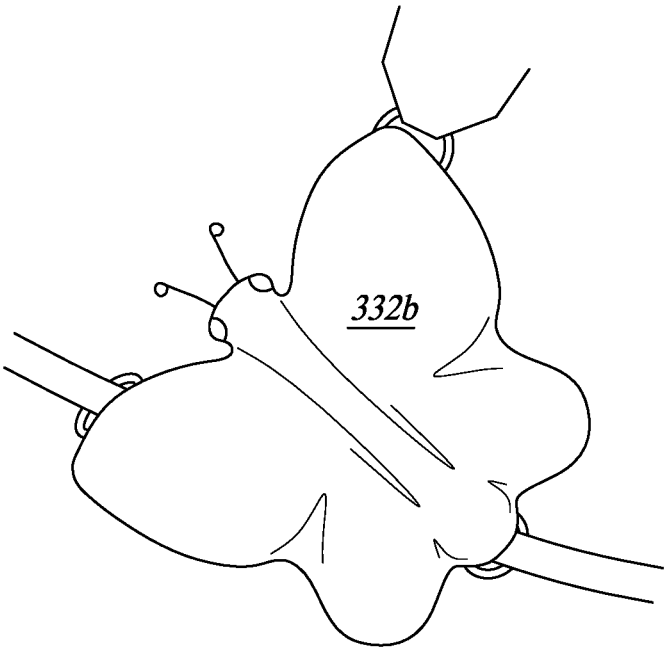
Figure 27:
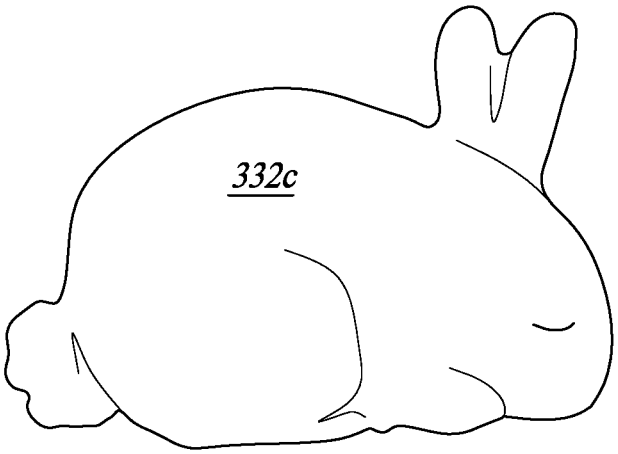

FIGS. 22-27 illustrate an ergonomic harness 330 according to an embodiment. The ergonomic harness 330 features a contiguous solid counterweight 332. The solid counterweight 332 serves as a coupler, joining the back strap 102, the shoulder strap 104, and the adjustable length strap 108 via a plurality of connectors 334. In an embodiment, the solid counterweight 332 has a somewhat irregular shape, for example, an ellipsoid having four foci. The solid counterweight 332 may desirably weigh in the range of about 0.5-5.0 pounds and can be made of various materials such metal, molded plastic, natural stone, ceramic, wood, or engineered stone. The solid counterweight 332 may include a protective or a decorative surface covering in the form of a thin layer of material bonded to the surface or painted on the surface. Additionally or alternatively, the solid counterweight 332 may be in the shape of a recognizable object such as an animal shape, a sports logo shape, or the like. Exemplary designs for counterweights 332*a*, 332*b*, and 332*c* are shown in FIGS. 25-27, respectively. The ergonomic harness 330 may be used as a musical instrument harness, or it may be used to support other types of loads, for example, for use as a baby carrier, for use in carrying heavy objects around a construction site, or as a weight belt, featuring the specialized solid counterweight 332 having an ellipsoid shape as described and shown herein.

All of the U.S. patents, U.S. patent application publications, U.S. patent applications, foreign patents, foreign patent applications and non-patent publications referred to in this specification and/or listed in the Application Data Sheet are incorporated herein by reference, in their entireties.

It will be appreciated that, although specific embodiments of the present disclosure are described herein for purposes of illustration, various modifications may be made without departing from the spirit and scope of the present disclosure. The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An apparatus, comprising:

a back strap;

a shoulder strap that releasably and adjustably connects to the back strap to form a closed loop;

an adjustable length strap;

a counterweight coupled to the back strap, the shoulder strap, and the adjustable length strap; and a connector configured to releasably attach the adjustable length strap to a violin or viola.

2. The apparatus of claim 1 wherein the connector is a clip having a male portion attached to one end of the adjustable strap and a female portion that releasably attaches to the violin or viola.

3. The apparatus of claim 1 wherein the counterweight includes one or more counterweight connectors.

4. The apparatus of claim 1 wherein the adjustable strap is attached to the violin or viola via a removable accessory.

5. The apparatus of claim 4 wherein the removable accessory includes one or more of a chinrest, a shoulder rest, a button, an endpin, a tailpiece, a clamping bracket, an endpin bracket, and a swiveling pin.

6. The apparatus of claim 1, further comprising a protective flap positioned between the violin or viola and the connector, the protective flap preventing contact between the violin or viola and the connector.

7. The apparatus of claim 1, wherein one or more of the back strap and the shoulder strap are anatomically contoured.

8. The apparatus of claim 1 wherein the adjustable length strap is attached to the violin or viola via a strap clamp having a top plate and a base plate that close around an end of the adjustable length strap.

9. An apparatus, comprising:

a first shoulder strap having an adjustable length;

a back strap coupled to the first shoulder strap, the back strap including a closed shoulder loop;

a connector configured to releasably attach the first shoulder strap to a chin rest of a violin or viola; and a clip at a distal end of the back strap, the clip being configured to be releasably attachable to clothing of a player of the violin or viola.

10. An apparatus, comprising:

a closed loop that includes:

a back strap;

a shoulder strap releasably coupled to the back strap;

an adjustable length strap coupled to the closed loop;

a counterweight coupled to the back strap, the shoulder strap, and the adjustable length strap; and a connector that releasably attaches the adjustable length strap to a load.

11. The apparatus of claim 10 wherein the counterweight includes one or more of metal, molded plastic, natural stone, ceramic, and engineered stone.

12. The apparatus of claim 10 wherein the counterweight has an ellipsoid shape having four foci.

13. The apparatus of claim 10, wherein the load is a musical instrument.

14. The apparatus of claim 10, wherein the connector is configured to attach to an accessory of a musical instrument.

15. An apparatus, comprising:

an ellipsoid counterweight having a weight in the range of about 0.5- 5.0 pounds; and one or more connectors arranged to configure the ellipsoid counterweight as a coupler suitable to join a plurality of strap portions to one another to support a load.

16. The apparatus of claim 15, wherein the ellipsoid counterweight has four foci.

17. An apparatus, comprising:

a back strap;

a shoulder strap that releasably and adjustably connects directly to the back strap to form a closed loop;

an adjustable length strap;

a coupler that joins the back strap, the shoulder strap, and the adjustable length strap;

and a connector configured to releasably attach only one of the straps to a musical instrument.

* * * * *